US009279281B2

(12) United States Patent
Miller et al.

(10) Patent No.: US 9,279,281 B2
(45) Date of Patent: Mar. 8, 2016

(54) UNIVERSAL SENSING EDGE

(71) Applicant: Miller Edge, Inc., West Grove, PA (US)

(72) Inventors: Bearge D. Miller, West Grove, PA (US); Krishnaraj Tejeswi, Exton, PA (US)

(73) Assignee: MILLER EDGE, INC., West Grove, PA (US)

( * ) Notice: Subject to any disclaimer, the term of this patent is extended or adjusted under 35 U.S.C. 154(b) by 134 days.

(21) Appl. No.: 14/155,904

(22) Filed: Jan. 15, 2014

(65) Prior Publication Data

US 2014/0197014 A1 Jul. 17, 2014

Related U.S. Application Data

(60) Provisional application No. 61/888,202, filed on Oct. 8, 2013, provisional application No. 61/752,680, filed on Jan. 15, 2013.

(51) Int. Cl.
*H01H 35/00* (2006.01)
*E05F 15/44* (2015.01)

(52) U.S. Cl.
CPC ..... *E05F 15/44* (2015.01)

(58) Field of Classification Search
CPC ..... H01H 35/00; H01H 3/142; H01H 3/16
USPC ..... 200/61.42, 61.43, 61.73; 49/27
See application file for complete search history.

(56) References Cited

U.S. PATENT DOCUMENTS

| | | | | | |
|---|---|---|---|---|---|
| 5,023,411 | A | * | 6/1991 | Miller et al. | 200/61.43 |
| 5,327,680 | A | * | 7/1994 | Miller | 49/27 |
| 5,418,342 | A | | 5/1995 | Miller | |
| 5,728,984 | A | | 3/1998 | Miller | |
| 5,832,665 | A | * | 11/1998 | Miller et al. | 49/27 |
| 6,571,512 | B1 | | 6/2003 | Miller et al. | |
| 6,600,113 | B1 | | 7/2003 | Miller | |

* cited by examiner

*Primary Examiner* — Edwin A. Leon
*Assistant Examiner* — Iman Malakooti
(74) *Attorney, Agent, or Firm* — Panitch Schwarze Belisario & Nadel LLP

(57) ABSTRACT

A universally mountable sensing edge comprises an elongated sheath defining a compressible cavity with a force sensor located therein. A center securing member extends upwardly from the top wall of the sheath, has a T-shaped base portion and a removable mounting strip extending from the base portion. At least one T-shaped edge securing member extends upwardly from the top wall of the sheath at least a distance generally equivalent to the distance that the upward extension of the T-shaped base portion of the center securing member extends from the top wall of the sheath. The at least one T-shaped edge securing member is disposed proximate to at least one of the front and rear sidewalls of the sheath. The universal sensing edge is attachable to a structure compatible with the mounting strip, the base portion of the center securing member, or the T-shaped edge securing member.

16 Claims, 5 Drawing Sheets

UNIVERSAL SENSING EDGE

CROSS-REFERENCE TO RELATED APPLICATIONS

This application claims the benefit of U.S. Provisional Patent Application No. 61/752,680, filed Jan. 15, 2013, titled "Universal Mount for Sensing Edge," and similarly titled U.S. Provisional Patent Application No. 61/888,202, filed Oct. 8, 2013, each of which is incorporated by reference herein, as if fully set forth in its entirety.

BACKGROUND OF THE INVENTION

The present invention relates generally to a sensing edge for a structure that is movable through a range of motion between open and closed positions and, more particularly, to a universal mount for sensing edges, which can be used to attach a sensing edge to a variety of different automatic doors.

Sensing edges are generally well known and typically include an elongated outer sheath in which a force sensing switch (sensor) is positioned. The sensing edge is attached to a lead or bottom edge of a structure that is movable through a range of motion between open and closed positions, e.g., an automatic overhead door, by a securing or mounting ember located on the sensing edge. As the door closes, if an obstruction is present, pressure is applied to the sheath and the force sensing switch actuates suitable control circuitry for controlling the movement of the door. The force sensing switch positioned within the sheath typically comprises a pair of flexible, spaced-apart, electrically conductive sheets positioned on the upper and lower sides of a layer of non-conducting foam having a plurality of openings extending therethrough from the upper to the lower side. Upon application of force to the sheath, either or both of the conductive sheets are deflected into electrically conductive engagement with each other, to thereby complete an electrical connection and actuate suitable control circuitry for controlling (opening) the door.

Automatic doors generally have several different geometries for receiving the sensing edge. Accordingly, conventional sensing edges are typically manufactured with a corresponding number of different geometries to match the different door geometries. As a result, one drawback associated with conventional sensing edges is that sensing edge manufactures must manufacture the same sensing edges, with different mounting geometries. This increases the sensing edge manufacturer's costs. Another drawback associated with conventional sensing edges is that door manufacturers typically must maintain an inventory of each type of mounting geometry, which increases the door manufacturer's costs and makes inventory tracking more burdensome. Ultimately, the increases in manufacturing and inventory costs are imparted onto the end consumer.

Accordingly, it would be advantageous to have a single sensing edge with a universal mount for mounting onto a variety of structures, e.g., doors, with different sensing edge receiving geometries. Although multiple types of mounting geometries may be available and generally well known in the field, a single sensing edge with a universal mount was not previously available that could be readily attached to a variety of leading door edges at the time of installation regardless of the geometry of the door.

BRIEF SUMMARY OF THE INVENTION

Briefly stated, one aspect of the present invention is directed to a universally mountable sensing edge attachable to a leading edge of a structure that is movable through a range of motion between open and closed positions. The sensing edge causes the structure to at least stop moving during a closing motion by actuating a device upon a force being sensed by the sensing edge. The sensing edge comprises an elongated sheath extending a length in a first direction, having opposing top and bottom walls and opposing front and rear sidewalls connecting the top and bottom walls, the walls together defining a cavity. The elongated sheath is compressible upon application of an external force thereto. A sensor is located within the cavity for sensing a force applied to the sheath. A center securing member extends upwardly and substantially perpendicularly from the top wall of the sheath and is disposed approximately centrally between the front and rear sidewalls. The center securing member has a generally T-shaped base portion extending from the top wall of the sheath and a removable mounting strip extending upwardly from the T-shaped base portion such that the center securing member is attachable to a structure having one of (i) a mounting slot extending into the structure from leading edge and (ii) an approximately centrally located channel extending downwardly and outwardly from the leading edge of the structure. At least one T-shaped edge securing member extends upwardly and substantially perpendicularly from the top wall of the sheath at least a distance generally equal to the distance that the upward extension of the T-shaped base portion of the center securing member extends from the top wall of the sheath. The at least one T-shaped edge securing member is disposed proximate to at least one of the front and rear sidewalls, such that the at least one T-shaped edge securing member is attachable to a leading edge of the structure.

In accordance with another aspect, the present invention is directed to a universally mountable sensing edge attachable to a leading edge of a structure that is movable through a range of motion between open and closed positions. The sensing edge causes the structure to at least stop moving during a closing motion by actuating a device upon a force being sensed by the sensing edge. The sensing edge comprises an elongated sheath extending a length in a first direction, having opposing top and bottom walls and opposing front and rear sidewalls connecting the top and bottom walls, the walls together defining a cavity. The elongated sheath is compressible upon application of an external force thereto. A sensor is located within the cavity for sensing a force applied to the sheath. A center securing member extends upwardly and substantially perpendicularly from the top wall of the sheath and is disposed approximately centrally between the front and rear sidewalls. The center securing member has a generally T-shaped base portion extending from the top wall of the sheath and a removable mounting strip extending upwardly from the T-shaped base portion. An intersection point between the mounting strip and the T-shaped base portion defines a disconnect point configured for selective removal of the mounting strip from the T-shaped base portion. The center securing member is attachable to a structure having one of (i) a mounting slot extending into the structure from a leading edge and (ii) an approximately centrally located channel extending downwardly and outwardly from the leading edge of the structure. At least two T-shaped edge securing members extend upwardly and substantially perpendicularly from the top wall of the sheath at least a distance generally equal to the distance that the upward extension of the T-shaped base portion of the center securing member extends from the top wall of the sheath. The at least two T-shaped edge securing members are disposed proximate to the front and rear sidewalls, respectively, such that each of the at least two T-shaped edge securing members is attachable to a respective channel extending downwardly from a leading edge of the structure.

In accordance with another aspect, the present invention is directed to a method of mounting a universally mountable sensing edge to a leading edge of a structure that is movable through a range of motion between open and closed positions. The sensing edge causes the structure to at least stop moving during a closing motion by actuating a device upon a force being sensed by the sensing edge. The method comprises the step of obtaining a universally mountable sensing edge. The universally mountable sensing edge comprised an elongated sheath extending a length in a first direction, having opposing top and bottom walls and opposing front and rear sidewalls connecting the top and bottom walls. The walls together define a cavity. The elongated sheath is compressible upon application of an external force thereto. A sensor is located within the cavity for sensing a force applied to the sheath. A center securing member extends upwardly and substantially perpendicularly from the top wall of the sheath and is disposed approximately centrally between the front and rear sidewalls. The center securing member has a generally T-shaped base portion extending from the top wall of the sheath and a removable mounting strip extending upwardly from the T-shaped base portion. At least one T-shaped edge securing member extends upwardly and substantially perpendicularly from the top wall of the sheath at least a distance generally equal to the distance that the upward extension of the T-shaped base portion of the center securing member extends from the top wall of the sheath. The T-shaped edge securing member is disposed proximate to at least one of the front and rear sidewalls. The method further comprises the step of determining whether the structure has (i) a mounting slot extending into the structure from a leading edge, (ii) an approximately centrally located channel extending downwardly and outwardly from the leading edge of the structure, or (iii) at least one channel extending downwardly and outwardly from the leading edge of the structure, proximate at least one of a front or rear side of the leading edge. If the structure has (i), then the method comprises the step of advancing the mounting strip of the center securing member of the sensing edge into at least a portion of the mounting slot. If the structure has (ii), then the method comprises the step of removing the mounting strip from the center securing member of the sensing edge, and sliding the T-shaped base portion of the center securing member of the sensing edge into at least a portion of the approximately central channel of the structure. If the structure has (iii), then the method comprises the step of removing the mounting strip from the center securing member of the sensing edge, and sliding the at least one T-shaped edge securing member of the sensing edge into at least a portion of the at least one channel extending from the structure adjacent at least one of the front or rear sides of the leading edge of the structure.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the disclosure is not limited to the precise arrangements and instrumentalities shown. In the drawings.

DETAILED DESCRIPTION OF THE INVENTION

Figure 1:
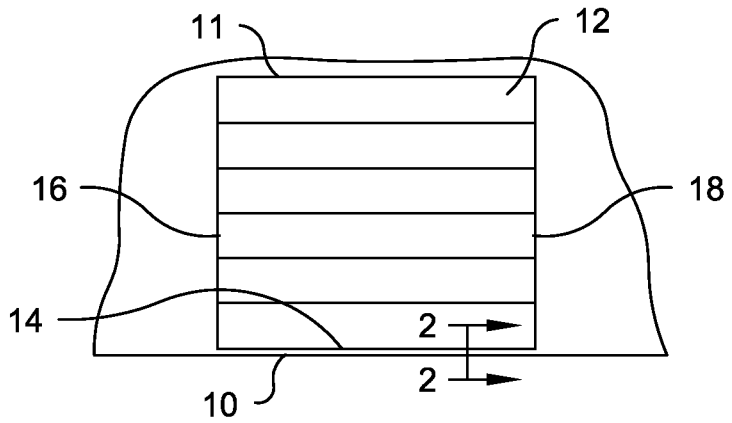
FIG. 1 is a front elevational view of a door including a universal sensing edge in accordance with a preferred embodiment of the present invention.

Certain terminology is used in the following description for convenience only and is not limiting. The words "right," "left," "lower," and "upper" designate directions in the drawings to which reference is made. The words "inwardly," "inner," "distally," "outer," "outwardly," or "proximally" refer to directions toward and away from, respectively, the geometric center or orientation of the device and related parts thereof. The terminology includes the above-listed words, derivatives thereof and words of similar import.

Referring to the drawings in detail, wherein like numerals indicate like elements throughout, there is shown in FIGS. 2-5 a universal sensing edge, generally designated 10, according to a first embodiment of the present invention. As shown in FIG. 1, the universal sensing edge 10 is capable of and configured to be mounted to and removed from a door 12, such as an overhead door, provided in a doorway 11. The universal sensing edge 10 preferably actuates a control device (not shown) to cause the door 12 to stop closing upon a force being applied to the universal sensing edge 10, usually as a result of an obstruction n the path of the door 12. As should be understood by those of ordinary skill in the art, although the door 12 may be an overhead door (e.g., a garage door) having the universal sensing edge 10 attached to a power side or leading edge surface 14 of the door 12, the universal sensing edge 10 may alternatively be attached to any edge or surface of the door 12 or even to the doorway 11. For example, the universal sensing edge 10 may be vertically disposed on horizontally movable doors (not shown), as desired. Moreover, as also should be understood by those of ordinary skill in the art, the universal sensing edge 10 is not limited to use in connection with doors, but may also be utilized with other applications, such as, for example, with automatic windows, gates and the like.

As shown in FIG. 1, the door 12 includes a leading (bottom) edge surface 14, a first lateral side surface 16 and a second lateral side surface 18. The first lateral side surface 16 and the second lateral side surface 18 extend generally, if not exactly, parallel to each other and perpendicularly to the leading edge surface 14, and are oppositely disposed. In some applications, the door 12 may be movably mounted on a track (not shown), e.g., attached to at least a portion of the doorway 11, which guides the door 12 through a range of motion between open and closed positions. However, as should be understood by those of ordinary skill in the art, other means of mounting the door 12 in the doorway 11 could be employed, including, for example, hinges and/or levers (not shown).

Figure 2:
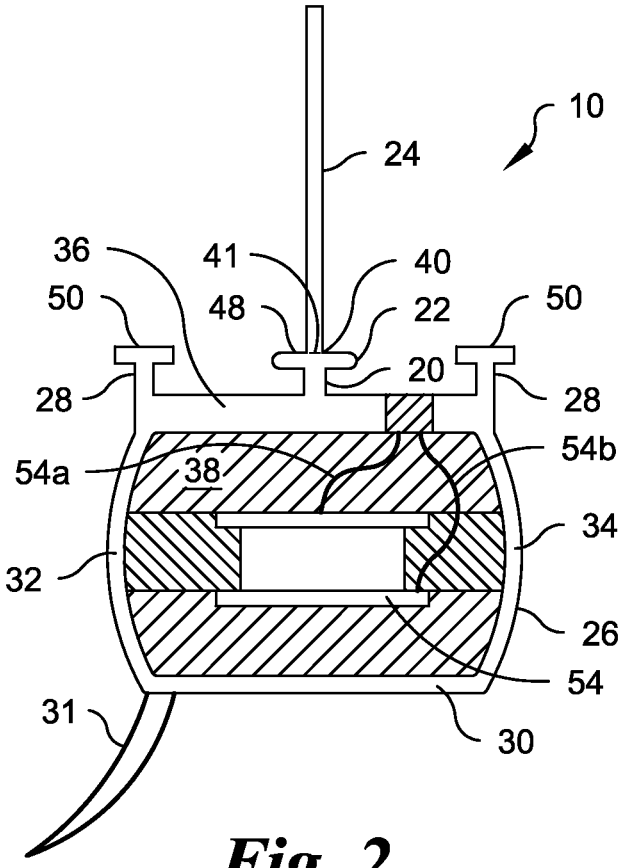
FIG. 2 is an enlarged cross-sectional elevational view of a universal sensing edge according to FIG. 1, generally taken along line 2-2 of FIG. 1.
Figure 3:
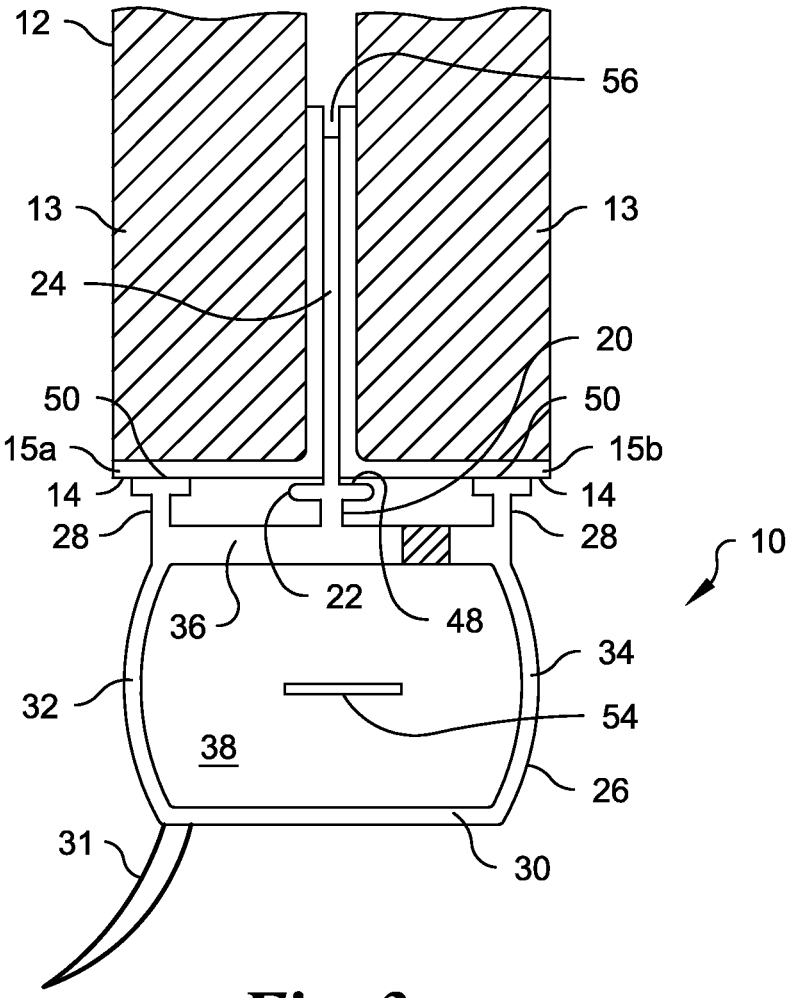
FIG. 3 is an enlarged cross-sectional elevational view of the universal sensing edge of FIG. 2, mounted to a door having a central mounting slot extending into a leading edge of the door.
Figure 4:
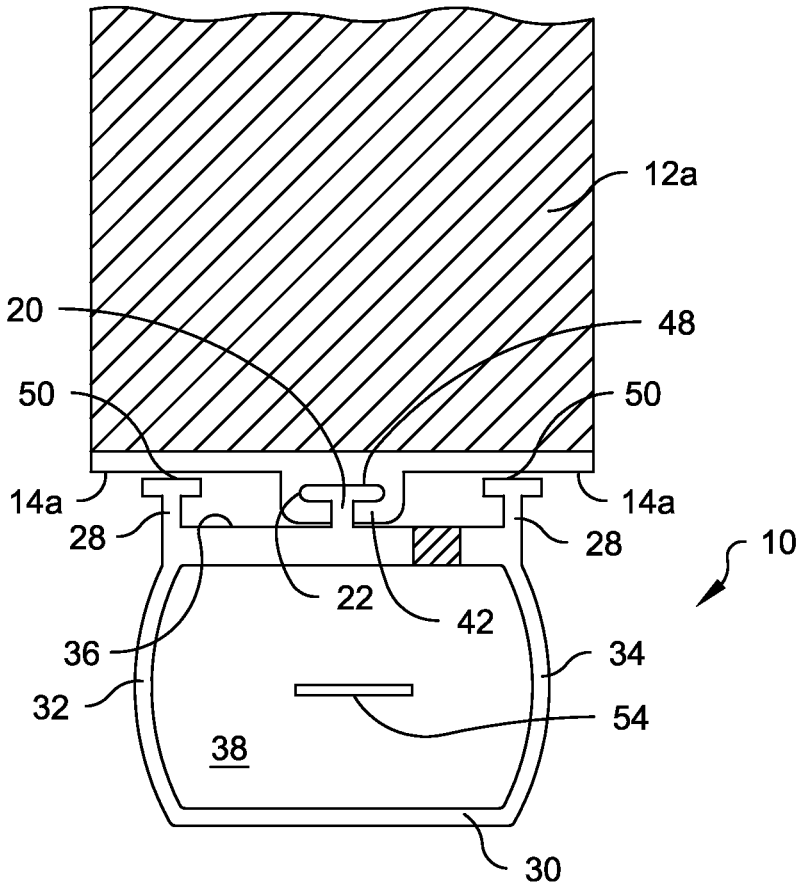
FIG. 4 is an enlarged cross-sectional elevational view of the universal sensing edge of FIG. 2, mounted to a door having a generally central channel extending downwardly from a leading edge of the door.
Figure 5:
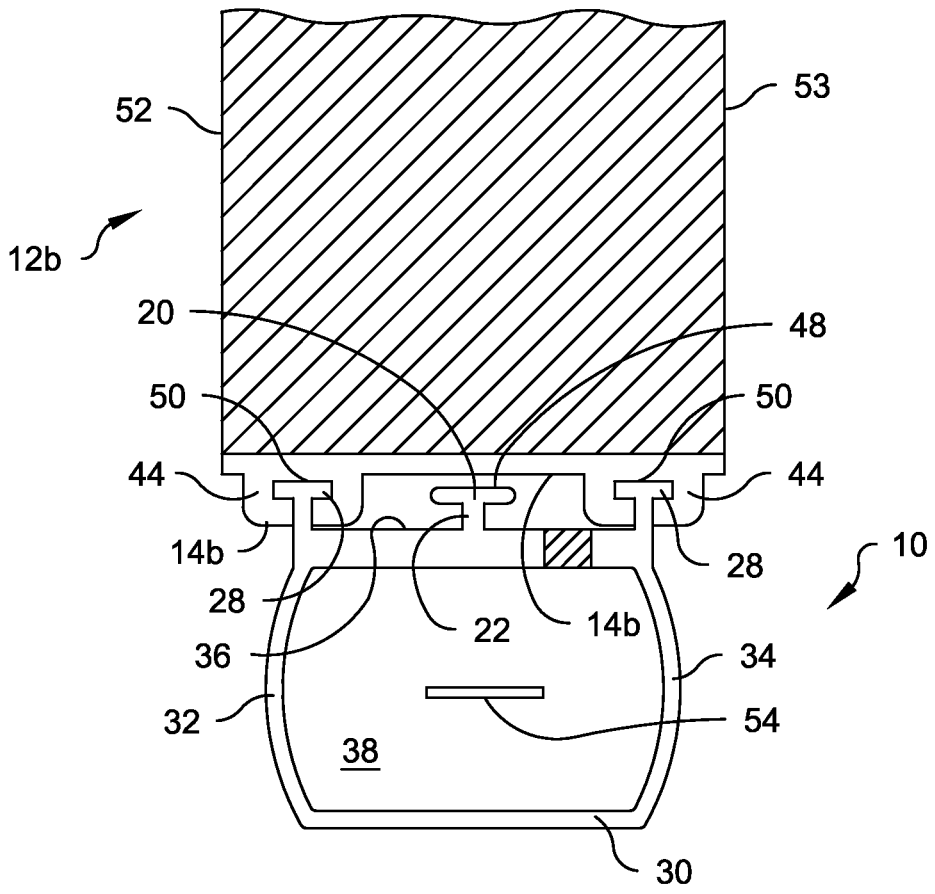
FIG. 5 is an enlarged cross-sectional elevational view of the universal sensing edge of FIG. 2, mounted to a door having a pair of spaced apart channels extending downwardly from a leading edge of the door.

As shown in FIGS. 2-5, the first preferred embodiment of the universal sensing edge 10 includes of an elongated outer sheath 26. When the sensing edge 10 is mounted to the leading edge 14 of a door 12, the sheath 26 extends outwardly and/or downwardly from the leading edge surface 14. The elongated sheath 26 forms and defines a generally hollow or open channel 38, which is at least slightly compressible upon application of an external force, such as the sheath 26 encountering and engaging an obstruction in the path of the closing door 12. The elongated sheath 26 includes a top wall 36 that is proximate to the leading edge surface 14 of the door 12 when the universal sensing edge 10 is attached to the door 12. The elongated sheath 26 also includes first and second lateral sidewalls 32, 34, which are generally oppositely disposed surfaces. The first and second sidewalls 32, 34 extend downwardly and/or outwardly, and generally perpendicularly, from the top wall 36 (parallel to front and rear surfaces of the door 12, as shown in FIGS. 3-5). A bottom wall 30 of elongated sheath 26 is preferably positioned opposite to the top wall 36 and generally perpendicularly to both the first and second sidewalls 32, 34. The top wall 36 and the bottom wall 30 extend generally, if not exactly, parallel to one another. Intersection and/or engagement between at least a portion of the top wall 36, the first and second sidewalls 32, 34, a pair of longitudinal end cups (not shown) and the bottom wall 30, provides a generally sealed water-tight enclosure that forms and defines the cavity 38. As shown in FIGS. 2 and 3, the bottom wall 30 may optionally include one or more elongated flaps 31 (only one shown) extending from the bottom wall 30 to assist in sealing the sensing edge 10 with an underlying surface, e.g., floor (not shown) when the door 12 is completely closed. The flap(s) 31 is particularly useful for uneven floors.

It is preferred that the elongated sheath 26 has a generally constant cross-sectional outline, extending along the leading edge surface 14 of the door 12 in a generally close or form-fitting manner. In the illustrated embodiment, the elongated sheath 26 is generally of rectangular cross-section, but may be of any other suitable shape, such as circular, semi-circular, ovular, triangular, square, or any other geometric shape. In some embodiments, the universal sensing edge 10 is secured to the leading edge surface 14 of a door 12 such that the first and second sidewalls 32, 34 of the elongated sheath 26 are coplanar with the first lateral side surface 32 and the second lateral side surface 34 of the door 12, respectively, when the universal sensing edge 10 is positioned adjacent to the leading edge surface 14 of the door 12.

As shown in FIGS. 3-5, a sensor 54 is positioned within the cavity 38 of the elongated sheath 26 and preferably extends generally the entire length of the universal sensing edge 10 from the first lateral side surface 16 to the second lateral side surface 18 of the door 12 in a manner well understood by those skilled in the art. In some embodiments, the sensor 54 comprises a standard multi-layered force sensing switch, such as is described in U.S. Pat. No. 6,571,512, issued Jun. 3, 2003, entitled "Universal Sensing Edge with Non-Melt End Closure," which is hereby incorporated by reference in its entirety as if fully set forth herein. The sensor 54 is in electrical connection with the control device (not shown) for controlling the opening and closing of the door 12 when the sensor 54 detects application of force to the sheath 26. As shown in FIG. 2, the sensor 54 is electrically connected to the control device (not shown) via first and second electrical conductors or wires 54*a*, 54*b*. Suitable control devices for controlling the actuation of the door 12 are well known to those of ordinary skill in the art, and therefore, further description of such control devices is omitted for purposes of brevity, and is not limiting. As also should be understood by those of ordinary skill in the art, additional or alternative objects may be positioned within the cavity 38 of the universal mounting edge 10 as required for different applications.

The universal sensing edge 10 includes a center securing member 20 that extends upwardly from the exterior surface of the top wall 36 of the elongated sheath 26. The center securing member 20 is positioned generally equidistant between the first and second sidewalls 32, 34 on the top wall 36. The center securing member 20 includes a T-shaped base portion 22 and a mounting strip 24. In some embodiments, the T-shaped base portion 22 is integrally formed with the exterior surface of the top wall 36, and the T-shaped base portion 22 has a generally flat top surface 48 that faces upwardly, i.e., away, from the elongated sheath 26. The mounting strip 24 is preferably integrally formed with, and extends outwardly from, the top surface 48 of the T-shaped base portion 22. The mounting strip 24 is preferably generally planar and/or linear in shape, and extends generally perpendicularly to the plane defined by the top wall 36 and the top surface 48. Both the T-shaped base portion 22 and the mounting strip 24 preferably span a length of the universal sensing edge 10, which is generally equal to a length of the leading edge surface 14 of the door 12. As should be understood by those of ordinary skill in the art, the exact lateral position of the center securing member 20 on the top wall 36 may vary depending on various types of leading edge surface 14 configurations of doors 12.

The universal sensing edge 10 also includes at least one, but preferably two or more, edge securing members 28. In the illustrated embodiment, the edge securing members 28 are generally T-shaped in cross-section, with at least a bottom portion, i.e., the base, of the "T", and preferably all of the edge securing members 28, being integrally formed with the exterior of the top wall 36. The edge securing members 28 extend outwardly and/or upwardly from the exterior surface of the top wall 36 of the elongated sheath 26. The edge securing members 28 are preferably located proximate to the lateral edges of the universal sensing edge 10 formed at the intersection of the top wall 36 and the first and second side walls 32, 34. Each edge securing member 28 has a generally flat top surface 50 that faces outwardly and/or upwardly from the elongated sheath 26. As should be understood by those of ordinary skill in the art, the shape of the edge securing members 28 may vary. The edge securing members 28 preferably span the entire length of the universal sensing edge 10.

As described in more detail below, the universal sensing edge 10 is attached to the leading edge surface 14 of the door 12 by the center securing member 20, the edge securing members 28, and/or a combination thereof. As should be understood by those of ordinary skill in the art, the position and number of edge securing members 28 on the top wall 36 of the elongated sheath 26 may vary depending on the configuration of the leading edge surface 14 on the door 12.

Preferably, the elongated sheath 26, the center securing member 20, and the edge securing members 28 are advantageously fabricated of a form-retaining but flexible material, such as, for example, rubber, and by an extrusion molding process. However, as should be understood by those of ordinary skill in the art, the elongated sheath 26, the center securing member 20, and the edge securing members 28 can alternatively be made of any form-retaining flexible material, such as, for example any elastomeric or other polymeric material or combination thereof.

As shown in FIG. 2, the center securing member 20 may have a disconnect point 40 located at the top surface 48 of the T-shaped base portion 22, specifically where the mounting strip 24 is integrally formed with the T-shaped base portion 22. At the disconnect point 40, the mounting strip 24 may be relatively easily removed from universal sensing edge 10 when desired, thereby modifying the center securing member 20 to only have the T-shaped base portion 22. The removable mounting strip 24 allows the user to relatively easily modify the sensing edge 10 at the time of installation onto the door 12 according to real-time assessments of the leading edge surface 14 configuration, as described in more detail below. To assist with removing the mounting strip 24, the disconnect point 40 may, in some embodiments, include an elongated score line 41, as shown in FIG. 2. However, as should be understood by those of ordinary skill in the art, the disconnect point 40 may include any of numerous different frangible connections connecting the mounting strip 24 to the base portion 22, such that the mounting strip is relatively easily removable as described herein.

To install the universal sensing edge 10, a user assesses the configuration of the leading edge surface 14 of the door 12. Accordingly, a user may modify the center securing member 20 of the universal sensing edge 10 as necessary to allow and/or provide for proper installation of the universal sensing edge 10, as described below.

As shown in FIG. 3, doors 12 that are compatible with the mounting strip 24 of the center securing member 20 typically include a plurality of connected panels, such as a bottom panel 13 that includes the leading edge surface 14. In one embodiment, the leading edge surface 14 of the door 12 may include first and second angle irons 15*a*, 15*b* that are mounted onto the bottom panel 13 of the door 12 along the major opposing surfaces. The angle irons 15*a*, 15*b* may be held in place by conventional fasteners, such as nuts and bolts (not shown) and form a mounting slot 56 therebetween.

To install the universal securing edge 10 onto the door 12 of FIG. 3, the mounting strip 24 is advanced into at least a portion of the mounting slot 56 between each angle iron 15*a*, 15*b*. The mounting strip 24 may be secured in place within the mounting slot 56 via any of numerous different methods and means, such as, for example, via a dimensional interference fit causing friction, one or more fasteners, and/or adhesive, in a manner well understood by those of ordinary skill in the art. The mounting strip 24 is tensioned perpendicularly and outwardly from the top wall 36 of the elongated sheath 26, causing the leading edge 14 of the door 12 to tightly engage the top surface 48 of the T-shaped base portion 22 of the center securing member 20. The tensioned mounting strip 24 also causes the leading edge 14 of the door 12 to engage the top surface 50 of the edge securing members 28. if desired, an adhesive may be applied to the top surfaces 48, 50 to further secure the sensing edge 10 to the leading edge 14 of the door 12.

As shown in FIG. 4, the universal sensing edge 10 is also capable of, and configured to, attach to a door 12*a* which has a leading edge surface 14*a* that is generally incompatible with the mounting strip 24 of the center securing member 20. Rather, the leading edge surface 14*a* of the door 12*a* may include a center C-shaped channel 42 extending downwardly and outwardly from the center of the leading edge surface 14*a* of the door 12*a*.

To install the universal sensing edge 10 onto a leading edge surface 14*a* of a door 12*a* that has the center C-shaped channel 42, a user first removes the mounting strip 24 from the center securing member 20, preferably at or near the disconnect point 40. As should be understood by those or ordinary skill in the art, removal of the mounting strip 24 can be accomplished with any suitable tool, such as, for example, with a utility knife, scissors, band-saw, or the like. Alternatively, a portion of the mounting strip 24 may be at least partially serrated to allow a user or installer to remove the mounting strip 24 simply by hand and without tools. After the mounting strip 24 is removed, the remaining T-shaped base portion 22 of the center securing member 20 is preferably inserted and/or slid into at least a portion of the center C-shaped channel 42.

As should be understood by those of ordinary skill in the art, the T-shaped base portion 22 may be secured within the center C-shaped channel 42 by a friction fit, adhesive, and/or any other conventional securing means. In some embodiments, when the T-shaped base portion 22 is inserted into the channel 42, the edge securing members 28 abut the leading edge surface 14*a* of the door 12*a* to assist in further stabilizing the sensing edge 10 relative to the door 12*a*. Adhesive may also be applied to at least a portion of the top surface 48 of the T-shaped base portion 22 of the center securing member 20, the interior of the center C-shaped channel 42, the leading edge surface 14*a* of the door 12*a*, and/or the top surface 50 of the edge securing members 28 or the exterior of the top wall 36 of the universal sensing edge 10.

As shown in FIG. 5, the universal mounting edge 10 is also capable of, and configured to, attach to a door 12*b* which has a leading edge surface 14*b* that is generally incompatible with the center securing member 20 all together. The leading edge surface 14*b* of the door 12*b* preferably includes at least one, but preferably a pair of edge C-shaped channels 44 that extend downwardly and/or outwardly from the leading edge surface 14*b* of the door 12*b*. The edge C-shaped channels 44 are generally located on the leading edge 14*b* of the door 12*b* proximate to and/or at an interior 52 and an exterior 53 side of the door 12*b*. However, as should be understood by those of ordinary skill in the art, the edge C-shaped channels 44 may alternatively be located anywhere on the leading edge surface 14*b* of the door 12*b*.

To install the universal sensing edge 10 onto a leading edge surface 14*b* of a door 12*b* that has edge C-shaped channels 44, a user first removes the mounting strip 24 from the center securing member 20, in similar manner as described above with respect to installation of the sensing edge 10 to a door 12*a* (FIG. 4). After the mounting strip 24 is removed, the edge securing members 28 are preferably inserted and/or slid into the edge C-shaped channels 44.

As also should be understood by those of ordinary skill in the art, the edge securing members 28 may be secured within the edge C-shaped channels 44 by a friction fit, adhesive, and/or any other conventional securing means. Adhesive may also be applied to at least a portion of the top surface 50 of the edge securing members 28, the interior of the edge C-shaped channels 44, the leading edge surface 14*b* of the door 12*b*, and/or the exterior of the top wall 36 of the universal sensing edge 10.

From the foregoing description, it can be seen that the present invention comprises a universal sensing edge 10 for causing a closing door 12 to open via a control device upon force, such as from an obstruction in the path of the door 12, being applied to the universal sensing edge 10. The universal sensing edge 10 of the present invention overcomes the inherent problems associated with the sensing edges of the prior art by providing the versatile combination center securing member 20 and edge securing members 28, wherein the universal securing edge 10 can be customized at the time of installation based on the specific leading edge surface 14, 14*a*, 14*b* configuration of a door 12, 12*a*, 12*b*. Being able to measure, configure, and install hardware all in a single stage saves time, advantageously makes material transport easier for installers, eliminates wasteful spending on incompatible hardware and allows for more efficient inventory control.

Figure 6:
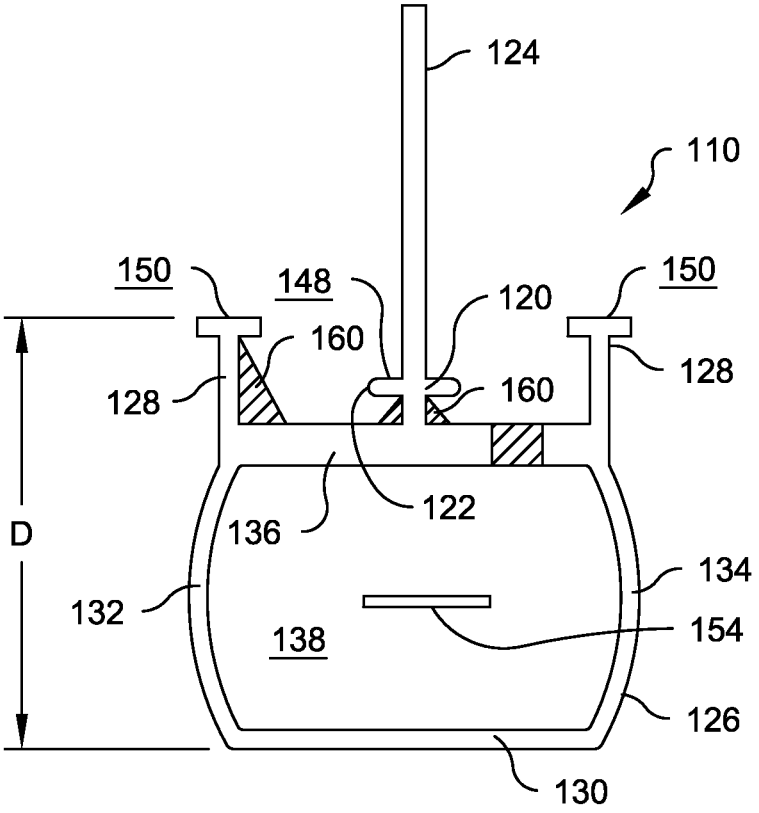
FIG. 6 is an enlarged cross-sectional view of a universal sensing edge according to a second embodiment of the present invention.

FIG. 6 shows a second embodiment of the universal sensing edge 110. The reference numerals of the second embodiment are distinguishable from those of the first embodiment by a factor of one-hundred (100), but otherwise indicate the same elements as indicated in the first embodiment, except as otherwise specified. The universal sensing edge 110 of the second embodiment is substantially similar to that of the first embodiment. The description of certain similarities between the embodiments may be omitted herein for the sake of brevity and convenience, and, therefore, is not limiting.

A distinguishing feature of the second embodiment is that a height of the edge securing members 128 of the universal mounting edge 110 is preferably greater than that of the edge securing members 28 of the universal mounting edge 10 of the first embodiment. In particular, it is preferred that a linear distance D, as shown in FIG. 6, from the bottom wall 130 of the elongated sheath 126 to the top surface 150 of each edge securing member 128 is preferably within the range of about 3 inches to about 4 inches. Increasing the height of the edge securing members 128 provides the sensor(s) 154 with additional time to recognize positional impact between an object and at least a portion of the door 12 before it is desirable to stop and/or reverse the motion or movement of the door 12.

In the illustrated embodiment, each edge securing member 128 extends upwardly and/or outwardly from the top wall 136 further than the top surface 148 of the T-shaped base portion 122 of the center securing member 120. Accordingly, as should be understood by those of ordinary skill in the art, the universal sensing edge 110 is compatible for attachment to doors that are compatible with the mounting strip 124 of the center securing member 120, such as door 12 (FIG. 3) and compatible for attachment to doors that are compatible with the edge securing members 128, such as door 12*b* (FIG. 5). The universal sensing edge 110 is attachable to the doors 12, 12*b* in similar manner as described above with respect to the attachment of universal sensing edge 10 to the doors 12, and 12*b*.

As shown in FIG. 6, one or more of the edge securing members 128 and the T-shaped base portion 122 of the center securing member 120 may include one or more reinforcement members 160. The reinforcement members 160 preferably extend from a portion of one or more of the edge securing members 128 and the T-shaped base portion 122 to an upper or top surface of the top wall 136 of the elongated sheath 126. As should be understood by those of ordinary skill in the art, the reinforcement members 160 are not limited to being included with or attached to each edge securing member 128 and the T-shaped base portion 122. Alternatively, a reinforcement member 160 may be positioned adjacent, or attached to, one of the edge securing members 128 on a side of the universal mounting edge 110 that is more likely to be a point of weakness when the door (not shown in FIG. 6) contacts an object.

The reinforcement members 160 may have a generally triangular shape in end view. However, the reinforcement members 160 are not limited to such a shape, as the reinforcement members 160 could be square, rectangular or even eccentrically shaped. The reinforcement members 160 preferably provide additional rigidity and/or support to the edge securing members 128 and the T-shaped base portion 122, which helps to prevent the universal sensing edge 110 from becoming undesirably skewed or misaligned with respect to the door. In some embodiments, the reinforcing member 160 may extend along the entire length of the sensing edge 110 or multiple reinforcing members 160 may be employed at spaced locations along the length of the sheath 126.

Alternatively, while the edge securing members 128 are generally linear in the vertical direction, it should understood by those of ordinary skill in the art that the edge securing members 128 could be accordion or zigzag-shaped (not shown) to accomplish the same function.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

We claim:

1. A universally mountable sensing edge attachable to a leading edge of a structure that is movable through a range of motion between open and closed positions, for causing the structure to at least stop moving during a closing motion by actuating a device upon a force being sensed by the sensing edge, the sensing edge comprising:

an elongated sheath extending a length in a first direction, having opposing top and bottom walls and opposing front and rear sidewalls connecting the top and bottom walls, the walls together defining a cavity, said elongated sheath being compressible upon application of an external force thereto;

a sensor located within the cavity for sensing a force applied to the sheath;

a center securing member extending upwardly and substantially perpendicularly from the top wall of the sheath and being disposed approximately centrally between the front and rear sidewalls, the center securing member having a generally T-shaped base portion extending from the top wall of the sheath and a removable mounting strip extending upwardly from the T-shaped base portion, an intersection point between the mounting strip and the T-shaped base portion defines a disconnect point configured for selective removal of the mounting strip from the T-shaped base portion such that the center securing member is attachable to a structure having one of (i) a mounting slot extending into the structure from a leading edge and (ii) an approximately centrally located channel extending downwardly and outwardly from the leading edge of the structure; and at least one T-shaped edge securing member extending upwardly and substantially perpendicularly from the top wall of the sheath at least a distance generally equal to the distance that the upward extension of the T-shaped base portion of the center securing member extends from the top wall of the sheath, the T-shaped edge securing member being disposed proximate to at least one of the front and rear sidewalls, such that the at least one T-shaped edge securing member is attachable to a leading edge, of the structure.

2. The universally mountable sensing edge as defined in claim 1, wherein the disconnect point is at least partially serrated.

3. The universally mountable sensing edge as defined in claim 1, wherein the disconnect point defines a score line.

4. The universally mountable sensing edge as defined in claim 1, wherein the at least one T-shaped edge securing member is attachable to a channel extending downwardly and outwardly from the leading edge of the structure.

5. The universally mountable sensing edge as defined in claim 1, wherein the at least one T-shaped edge securing member comprises two T-shaped edge securing members being disposed proximate to each of the front and rear sidewalls, respectively.

6. The universally mountable sensing edge as defined in claim 1, wherein the T-shaped base portion of the center securing member is integrally formed with the top wall of the sheath.

7. The universally mountable sensing edge as defined in claim 6, wherein the mounting strip of the center securing member is integrally formed with the T-shaped base portion of the center securing member.

8. The universally mountable sensing edge as defined in claim 1, wherein the at least one T-shaped edge securing member is integrally formed with the top wall of the sheath.

9. The universally mountable sensing edge as defined in claim 1, wherein the center securing member and the at least one edge securing member span the length of the sheath.

10. The universally mountable sensing edge as defined in claim 1, wherein the sheath, the center securing member and the at least one edge securing member are constructed of a form-retaining, flexible polymeric material.

11. A universally mountable sensing edge attachable to a leading edge of a structure that is movable through a range of motion between open and closed positions, for causing the structure to at least stop moving during a closing motion by actuating a device upon a force being sensed by the sensing edge, the sensing edge comprising:

an elongated sheath extending a length in a first direction, having opposing top and bottom walls and opposing front and rear sidewalls connecting the top and bottom walls, the walls together defining a cavity, said elongated sheath being compressible upon application of an external force thereto;

a sensor located within the cavity for sensing a force applied to the sheath;

a center securing member extending upwardly and substantially perpendicularly from the top wall of the sheath and being disposed approximately centrally between the front and rear sidewalls, the center securing member having a generally T-shaped base portion extending from the top wall of the sheath and a removable mounting strip extending upwardly from the T-shaped base portion such that the center securing member is attachable to a structure having one of (i) a mounting slot extending into the structure from a leading edge and (ii) an approximately centrally located channel extending downwardly and outwardly from the leading edge of the structure; and at least one T-shaped edge securing member extending upwardly and substantially perpendicularly from the top wall of the sheath a distance greater than the distance that the upward extension of the T-shaped base portion of the center securing member extends from the top wall of the sheath, the T-shaped edge securing member being disposed proximate to at least one of the front and rear sidewalls, such that the at least one T-shaped edge securing member is attachable to a leading edge of the structure.

12. A universally mountable sensing edge attachable to a leading edge of a structure that is movable through a range of motion between open and closed positions, for causing the structure to at least stop moving during a closing motion by actuating a device upon a force being sensed by the sensing edge, the sensing edge comprising:

an elongated sheath extending a length in a first direction, having opposing top and bottom walls and opposing front and rear sidewalls connecting the top and bottom walls, the walls together defining a cavity, said elongated sheath being compressible upon application of an external force thereto;

a sensor located within the cavity for sensing a force applied to the sheath;

a center securing member extending upwardly and substantially perpendicularly from the top wall of the sheath and being disposed approximately centrally between the front and rear sidewalls, the center securing member having a generally T-shaped base portion extending from the top wall of the sheath and a removable mounting strip extending upwardly from the T-shaped base portion such that the center securing member is attachable to a structure having one of (i) a mounting slot extending into the structure from a leading edge and (ii) an approximately centrally located channel extending downwardly and outwardly from the leading edge of the structure; and at least one T-shaped edge securing member extending upwardly and substantially perpendicularly from the top wall of the sheath at least a distance generally equal to the distance that the upward extension of the T-shaped base portion of the center securing member extends from the top wall of the sheath, the T-shaped edge securing member being disposed proximate to at least one of the front and rear sidewalls, such that the at least one T-shaped edge securing member is attachable to a leading edge of the structure, wherein at least one of the center securing member and the at least one T-shaped edge securing member includes at least one reinforcement member extending from a portion of the respective at least one of the center securing member and the at least one T-shaped edge securing member to the top wall of the sheath.

13. The universally mountable sensing edge as defined in claim 12, wherein the at least one reinforcement member is generally triangularly shaped in end view.

14. A universally mountable sensing edge attachable to a leading edge of a structure that is movable through a range of motion between open and closed positions, for causing the structure to at least stop moving during a closing motion by actuating a device upon a force being sensed by the sensing edge, the sensing edge comprising:

an elongated sheath extending a length in a first direction, having opposing top and bottom walls and opposing front and rear sidewalls connecting the top and bottom walls, the walls together defining a cavity, said elongated sheath being compressible upon application of an external force thereto;

a sensor located within the cavity for sensing a force applied to the sheath;

a center securing member extending upwardly and substantially perpendicularly from the top wall of the sheath and being disposed approximately centrally between the front and rear sidewalls, the center securing member having a generally T-shaped base portion extending from the top wall of the sheath and a removable mounting strip extending upwardly from the T-shaped base portion and wherein an intersection point between the mounting strip and the T-shaped base portion defines a disconnect point configured for selective removal of the mounting strip from the T-shaped base portion such that the center securing member is attachable to a structure having one of (i) a mounting slot extending into the structure from a leading edge and (ii) an approximately centrally located channel extending downwardly and outwardly from the leading edge of the structure; and at least two T-shaped edge securing members extending upwardly and substantially perpendicularly from the top wall of the sheath at least a distance generally equal to the distance that the upward extension of the T-shaped base portion of the center securing member extends from the top wall of the sheath, the T-shaped edge securing members being disposed proximate to the front and rear sidewalls, respectively, such that each of the at least two T-shaped edge securing members is attachable to a respective channel extending downwardly from a leading edge of the structure.

15. A method of mounting a universally mountable sensing edge to a leading edge of a structure that is movable through a range of motion between open and closed positions, for causing the structure to at least stop moving during a closing motion by actuating a device upon a force being sensed by the sensing edge, the method comprising:

obtaining a universally mountable sensing edge comprising:

an elongated sheath extending a length in a first direction, having opposing top and bottom walls and opposing front and rear sidewalls connecting the top and bottom walls, the walls together defining a cavity, said elongated sheath being compressible upon application of an external force thereto;

a sensor located within the cavity for sensing a force applied to the sheath;

a center securing member extending upwardly and substantially perpendicularly from the top wall of the sheath and being disposed approximately centrally between the front and rear sidewalls, the center securing member having a generally T-shaped base portion extending from the top wall of the sheath and a removable mounting strip extending upwardly from the T-shaped base portion and an intersection point between the mounting strip and the T-shaped base portion defines a disconnect point configured for selective removal of the mounting strip from the T-shaped base portion, and at least one T-shaped edge securing member extending upwardly and substantially perpendicularly from the top wall of the sheath at least a distance generally equal to the distance that the upward extension of the T-shaped base portion of the center securing member extends from the top wall of the sheath, the T-shaped edge securing member being disposed proximate to at least one of the front and rear sidewalls;

determining whether the structure has (i) a mounting slot extending into the structure from a leading edge, (ii) an approximately centrally located channel extending downwardly and outwardly from the leading edge of the structure, or (iii) at least one channel extending downwardly and outwardly from the leading edge of the structure, proximate at least one of a front or rear side of the leading edge, wherein;

if the structure has (i), then:

advancing the mounting strip of the center securing member of the sensing edge into at least a portion of the mounting slot;

if the structure has (ii), then:

removing the mounting strip from the center securing member of the sensing edge, and sliding the T-shaped base portion of the center securing member of the sensing edge into at least a portion of the approximately central channel of the structure; and if the structure has (iii), then:

removing the mounting strip from the center securing member of the sensing edge, and sliding the at least one T-shaped edge securing member of the sensing edge into at least a portion of the at least one channel extending from the structure adjacent at least one of the front or rear sides of the leading edge of the structure.

16. The method of mounting a universally mountable sensing edge of claim 15, wherein if the structure has (ii) or (iii), then the removing step further comprises removing the mounting strip from the center securing member of the sensing edge at the disconnect point between the mounting strip and the T-shaped base portion of the center securing member.

* * * * *